US006971907B1

(12) United States Patent
Stroud

(10) Patent No.: US 6,971,907 B1
(45) Date of Patent: Dec. 6, 2005

(54) CONFIGURABLE LIGHTED CONNECTOR

(75) Inventor: Micah S. Stroud, San Jose, CA (US)

(73) Assignee: Nvidia Corporation, Santa Clara, CA (US)

( * ) Notice: Subject to any disclaimer, the term of this patent is extended or adjusted under 35 U.S.C. 154(b) by 0 days.

(21) Appl. No.: 10/890,962

(22) Filed: Jul. 13, 2004

(51) Int. Cl.[7] ..... H01R 3/00
(52) U.S. Cl. ..... 439/490; 439/668
(58) Field of Search ..... 439/490, 668

(56) References Cited

U.S. PATENT DOCUMENTS

| | | | | |
|---|---|---|---|---|
| 4,978,317 | A * | 12/1990 | Pocrass | 439/490 |
| 5,601,451 | A * | 2/1997 | Driones et al. | 439/490 |
| 5,704,802 | A * | 1/1998 | Loudermilk | 439/490 |
| 5,885,100 | A * | 3/1999 | Talend et al. | 439/490 |
| 5,924,889 | A * | 7/1999 | Wang | 439/490 |
| 6,224,408 | B1 | 5/2001 | Wu | 439/188 |
| 6,224,409 | B1 | 5/2001 | Chang | 439/188 |
| 6,227,905 | B1 | 5/2001 | Tsai et al. | 439/541.5 |
| 6,234,833 | B1 | 5/2001 | Tsai et al. | 439/541.5 |
| 6,257,934 | B1 | 7/2001 | Gong et al. | 439/668 |
| 6,346,013 | B1 | 2/2002 | Zhang et al. | 439/668 |
| 6,364,717 | B1 | 4/2002 | Lin | 439/668 |
| 6,409,530 | B1 * | 6/2002 | Zhao et al. | 439/188 |
| 6,482,044 | B1 | 11/2002 | Ma et al. | 439/668 |
| 6,491,533 | B2 | 12/2002 | Costello et al. | 439/188 |
| 6,561,847 | B1 | 5/2003 | Xiang et al. | 439/541.5 |
| 6,568,963 | B2 | 5/2003 | Zhang et al. | 439/668 |
| 6,572,402 | B2 * | 6/2003 | Lin | 439/490 |
| 6,575,793 | B1 | 6/2003 | Li et al. | 439/668 |
| 6,618,636 | B1 | 9/2003 | Sakai et al. | 700/94 |
| 6,688,908 | B2 * | 2/2004 | Wallace | 439/490 |
| 2004/0242087 | A1 * | 12/2004 | Hoshina | 439/894 |

OTHER PUBLICATIONS

Tech Inside; S/PDIF (Sony/Philips Digital Interface) Connector; 1 Sheet; http://english.aopen.com.tw/tech/techinside/spdif.htm.

RCA connector; Copyright 2000-2004, TechTarget; 3 Sheets; http://searchNetworking.techtarget.com/sDefinition/0,,sid7_gci786116,00.html.

S/PDIF; Copyright 2004, Jupitermedia; 2 Sheets; http://www.webopedia.com/TERM/S/S_PDIF.html.

Smart 5.1 Mainboard; Intelligent 6 Channel Audio, The Technology Behind The Feature, Enabling Smart5.1, Availability; 2001-2003 VIA Technologies, Inc; 4 Sheets; http://www.viaarena.com/?PageID=162.

(Continued)

*Primary Examiner*—Hae Moon Hyeon
(74) *Attorney, Agent, or Firm*—Wagner, Murabito & Hao LLP

(57) ABSTRACT

A communication connector, in accordance with one embodiment of the invention, includes an insulative housing having a cylindrical opening, a light source, and a first and second electrical interconnect. The insulative housing includes a body portion and a head portion. The cylindrical opening extends through the head portion and partially into the body portion of the insulative housing. The light source is disposed in the insulative housing proximate the head portion. The first electrical interconnect includes a terminal portion for fixedly connecting the communication connector to a device and a contact portion comprising a resilient conductive element disposed in the cylindrical opening for engaging a mating communication connector. The second electrical interconnect couples an indicator signal to the light source.

14 Claims, 6 Drawing Sheets

OTHER PUBLICATIONS

SigmaTel Announces the low-Cost STAC9752A C-Major Audio Codec for Cost Sensitive PC Applications; 2 Sheets; http://www.sigmatel.com/press/010604-stac9752-introduction.htm.

AC '97 Component Specification, Revision 2.3 Rev 1.0; 1.3 AC '97 Codec Block Diagram; p. 10; 1 Sheet.

AC '97 Component Specification, Revision 2.3 Rev 1.0; 1.4 Integrating AC '97 into the System; p. 11; 1 Sheet.

* cited by examiner

CONFIGURABLE LIGHTED CONNECTOR

BACKGROUND OF THE INVENTION

Referring to FIG. 1, an electronic device 100 according to the conventional art is shown. The electronic device 100 may be a desktop computer, laptop computer, palm-sized computer, tablet computer, game console, personal entertainment center, media center PC, cellular telephone, PDA or other portable wireless appliance, computer based simulator, or the like. As depicted in FIG. 1, the electronic device 100 includes a plurality of various communication connectors 105–150. The various communication connectors 105–150 are utilized to attach various peripheral components to the device 100. The peripheral components may include speakers, microphones, networks, monitors, printers, keyboards, pointing devices and/or the like. For example, one or more communication connectors (e.g., audio jacks 120–130) may be utilized to connect peripheral components such as speakers and/or microphones to the device.

Referring now to FIG. 2, an audio jack 200 according to the conventional art is shown. As depicted in FIG. 2, the audio jack 200 includes an insulating housing 210–215, and a plurality of interconnects 220–230. The insulating housing 210–215 includes a body portion 210 and a head portion 215. A cylindrical opening 235, for removably receiving a plug connector, extends through the head portion 215 and into the body portion 210. The interconnects 220–230 each include a terminal portion and a contact portion. The contact portion may be a resilient conductive element disposed in the cylindrical opening. The contact portion engages a particular portion of the audio plug when inserted into the cylindrical opening. The terminal portion is a conductive element for fixedly attaching the audio jack 200 to a device.

Referring again to FIG. 1, it may be necessary to add communication connectors 140–150 to the device to allow additional peripheral components to be connected to a given device 100. For example, a Sony-Phillips Digital Input/Output (S/PDIO) adapter may be added to a computer to support surround sound audio output. The S/PDIO adapter typically consumes a Peripheral Component Interface (PCI) slot in the computer system. Thus, the additional communication connectors 140–150 consume a significant amount of available area in the computer system. The additional communication connectors 140–150 also increase the cost of the computer system.

Typically, conventional communication connectors 105–150 are pre-colored depending upon the functional connection (e.g., line-out, line-in, mic-in). For example, a conventional computer system typically has three jacks 120–130 providing a line-out connection, a line-in correction and a mic-in connection. The line-out is typically utilized to provide left and right audio output channels to drive a set of speakers. The line-in connection is typically utilized to receive data from peripheral devices such as mini disks. The mic-in connection is typically utilized to receive audio input from a microphone. The jacks 120–130 providing mic-in, line-out, and line-in functions may be pre-colored red, green and blue respectively. The pre-colored communication connectors 105–150 are intended to simplify connectivity of peripheral components to the device.

In order to reduce the size and/or cost of electronic devices 100, such as computers, game consoles, and personal entertainment centers, it may desirable to reconfigure one or more communication connectors 105–150. However, if one or more of the communication connectors 105–150 are re-configured, the pre-colored communication connectors may no longer correspond to the new communication function provided by the communication connector. Thus, the pre-color communication connectors 105–150 utilized in combination with re-configurability may make connectivity more difficult for users.

SUMMARY OF THE INVENTION

Embodiments of the present invention are directed toward an improved communication connector. In one embodiment, the communication connector includes a housing having an opening, a light source, and a first and second interconnect. The light source is disposed in the housing and is operable to emit illumination. The opening is operable for removably receiving a mating communication connector. The first interconnect is operable to couple a communication signal between a device and a peripheral component. The second interconnect is operable to couple an indicator signal to the light source.

In another embodiment, the communication connector may be a jack. The jack includes an insulative housing having a cylindrical opening, a light source, and a first and second electrical interconnect. The insulative housing includes a body portion and a head portion. The cylindrical opening extends through the head portion and partially into the body portion of the insulative housing. The light source is disposed in the insulative housing proximate the head portion. The first electrical interconnect includes a terminal portion for fixedly connecting the jack to a device. The first electrical interconnect also includes a contact portion consisting of a resilient conductive element disposed in the cylindrical opening for engaging a plug. The second electrical interconnect couples an indicator signal to the light source.

Another embodiment provides a method of configuring a plurality of jacks. The method includes receiving an identifier of a peripheral component to be added to a device. A jack to be used to connect the peripheral component to the device is illuminated. The jack is also configured to provide the appropriate audio function.

Advantageously, embodiments simplify connectivity of peripheral components to the device. Embodiments may advantageously reduce the cost of the device by reducing the number of jacks in the device. Embodiments may also advantageously reduce the form factor of the device by reducing the number of jacks in the device. Embodiments may also advantageously free-up area in the device previously occupied by conventional art audio jacks for use by additional circuits in the device.

BRIEF DESCRIPTION OF THE DRAWINGS

Embodiments of the present invention are illustrated by way of example and not by way of limitation, in the figures of the accompanying drawings and in which like reference numerals refer to similar elements and in which.

DETAILED DESCRIPTION OF THE INVENTION

Reference will now be made in detail to the embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the scope of the invention as defined by the appended claims. Furthermore, in the following detailed description of the present invention, numerous specific details are set forth in order to provide a thorough understanding of the present invention. However, it is understood that the present invention may be practiced without these specific details. In other instances, well-known methods, procedures, components, and circuits have not been described in detail as not to unnecessarily obscure aspects of the present invention.

Figure 1:
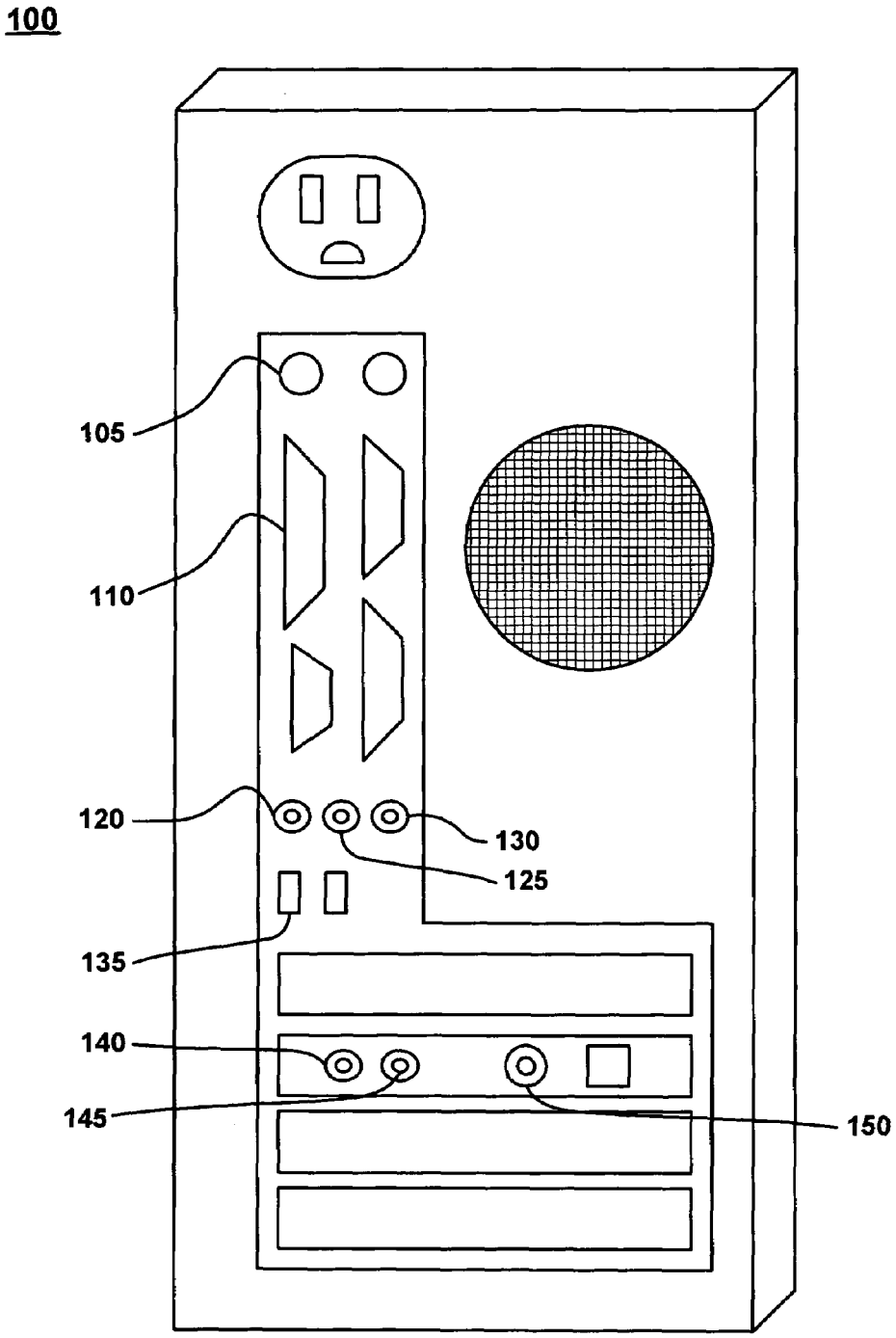
FIGURE 1 (CONVENTIONAL ART)
FIG. 1 shows an electronic device according to the prior art.
Figure 2:
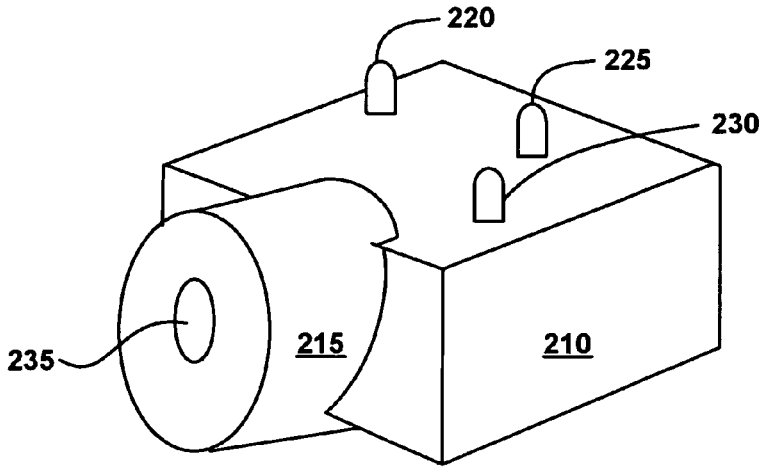
FIGURE 2 (CONVENTIONAL ART)
FIG. 2 shows an audio jack according to the prior art.
Figure 3A:
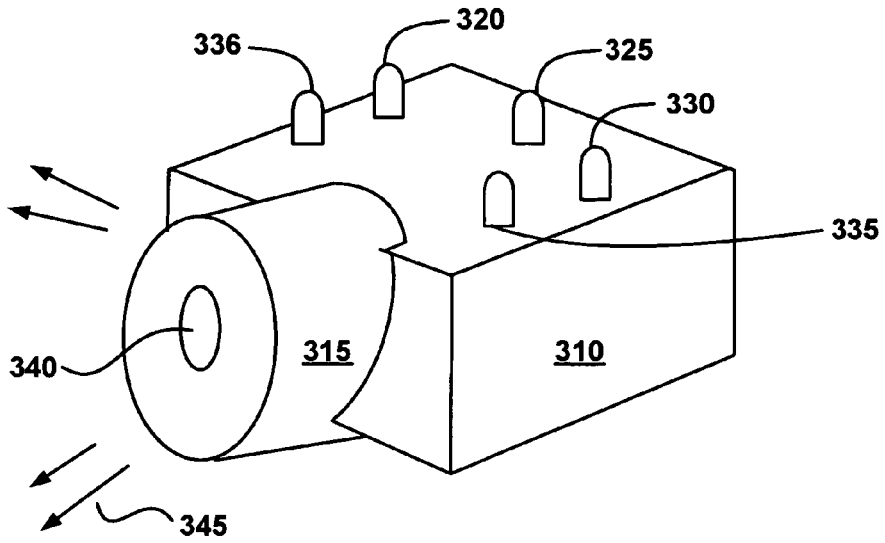
FIG. 3A shows a diagram of an exemplary communication connector, in accordance with one embodiment of the present invention.

Referring to FIG. 3A, a diagram of an exemplary communication connector 300, in accordance with one embodiment of the present invention, is shown. The communication connector 300 provides communication signal transmission function and a configuration indicator function. As depicted in FIG. 3A, the communication connector 300 includes a housing 310–315 and a plurality of interconnects 320–335 (e.g., wires, traces, etc.). The housing 310–315 includes an opening 340 for removably receiving a mating communication connector (not shown). The housing 310–315 is operable to emit illumination 345 to prompt a user to plug the mating communication connector of the appropriate peripheral component into the communication connector 300.

A first interconnect 335 receives an indicator signal for selectively controlling illumination 345 (e.g., color, brightness, etc.) emitted by the housing 310–315. A second interconnect 320 couples a communication signal between a device (e.g., computer, game console, personal entertainment center) and a peripheral component (e.g., speaker(s), microphone).

Although embodiments of the present invention are described herein with reference to a jack, it is appreciated that the embodiments of the present invention may be adapted for use with numerous other types of communication connectors, such as RCA connectors, coaxial connectors, USB connectors, FireWire connectors, DVI connectors, HDMI connectors, CAT5 connectors, telephone connectors, serial port connectors, RS-232 connectors, parallel port connectors, IEEE 1284 connectors, Centronics 36 connectors, DB25 port connectors, PS/2 port connectors, Ethernet connector, fiber optic cable connectors and the like. Although embodiments of the preset invention are described herein with reference to electromagnetic transmitted audio signals, it is appreciated that embodiments of the present invention may be adapted for use with any other communication means, such as electromagnetic transmitted video signals, electromagnetic transmitted data communication signals, optical transmitted audio signals, optical transmitted video signals, optical transmitted data communication signals and/or the like. It is also appreciated that illuminated communication connectors, in accordance with embodiments of the preset invention, are particularly advantageous for connecting peripheral components to a given device when the communication channel between the device and the peripheral component is a simplex communication link (e.g., communication in one direction).

Figure 3B:
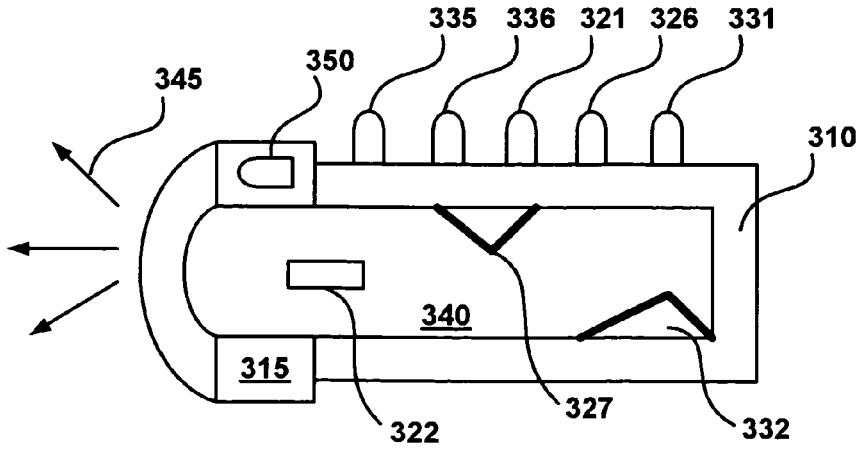
FIG. 3B shows a cross sectional view of an exemplary communication connector, in accordance with one embodiment of the present invention.

Referring now to FIG. 3B, a cross sectional view of an exemplary communication connector 300, in accordance with one embodiment of the present invention, is shown. In one implementation, the communication connector 300 may be a jack that provides a signal transmission function and a configuration indicator function. As depicted in FIG. 3B, the jack 300 includes an insulating housing 310–315, a plurality of interconnects 321–335 and a light source 350. The interconnects 321–335 may be electrical interconnects, optical interconnects and/or the like. The insulating housing 310–315 may include a body portion 310 and a head portion 315. A cylindrical opening 340, for removably receiving a plug connector, extends through the head portion 315 and partially into the body portion 310. The light source 350 may be disposed in the head portion 315 or the body portion 310, such that light 345 is emitted from the head portion 315 of the insulative body 310–315.

A first set of interconnects 335–336 couple one or more indicator signals (e.g., brightness, color, etc.) and/or supply potentials (e.g., source and ground) to the light source 350. A second set of interconnects 321–332 couple one or more communication signals (e.g., audio out, right channel, left channel, etc.) and/or supply potentials (e.g., source and ground) between a device (e.g., computer, game console, personal entertainment center, media center PC, portable wireless appliance/terminal) and a peripheral component (e.g., speaker(s), microphone).

In one implementation, one or more of electrical interconnects may each include a terminal portion 321, 326, 331 and a contact portion 322, 327, 332. The contact portion 322, 327, 332 may be a resilient conductive element disposed in the cylindrical opening 340. The contact portion 322, 327, 332 engages a particular portion of the plug when inserted into the cylindrical opening 340. The terminal portion 321, 326, 331 may be a conductive element for fixedly coupling to the device.

In one implementation, a first one of the electrical interconnects 321–322 may operably receive a first audio signal (e.g., left channel). A second one of the electrical interconnects 326–327 may operably receive a second audio signal (e.g., right channel). A third one of the electrical interconnects 335 may operably receive an indicator signal. The plurality of electrical interconnects 321–335 may also include a fourth electrical interconnect 331–332, for operably coupling a ground potential to the peripheral component. The plurality of electrical interconnects 335 may also include a fifth electrical interconnect 336 for operably coupling a ground potential to the light source 350.

In one implementation, the indicator signal may cause the light source 350 to emit a steady illumination or a time-varying (e.g., flashing) illumination to prompt a user to plug a particular peripheral component into the jack 300. The light source 350 may be a light emitting diode (LED), one or more LEDs, a multi-color LED or the like. In one implementation, the head portion 315 of the insulative body 310–315 may include a lens for directing the light emitted there from, a diffraction grating for dispersing the light emitted there from, a filter for selectively emitting a particular color of light, and/or the like.

Figure 4:
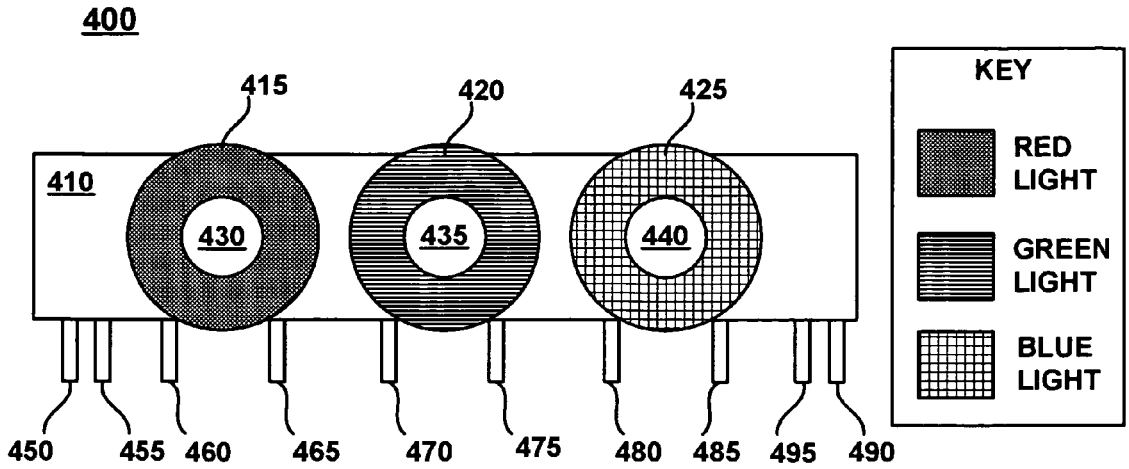
FIG. 4 shows a diagram of an exemplary multiple audio jack assembly, in accordance with one embodiment of the present invention.

Referring now to FIG. 4, a diagram of an exemplary multiple audio jack assembly 400, in accordance with one embodiment of the present invention, is shown. Although the multiple audio jack assembly 400 is illustrated as an integral assembly, it is appreciated that the multiple audio jack assembly 400 may be composed of a plurality of independent jack assemblies. As depicted in FIG. 4, the multiple audio jack assembly 400 includes an insulating housing 410–425 and a plurality of electrical interconnects 450–495. The insulating housing 410–425 includes a plurality of cylindrical opening 430–440 for removably receiving one or more audio plugs. A portion of one or more electrical interconnects 460–485 are disposed within a corresponding cylindrical opening 430–440 to resiliently engage an audio plug inserted therein. Each cylindrical opening 430–440 and portions of the associated electrical interconnects 460–495 disposed therein are referred to as a jack hereinafter. A portion of the insulating housing 415–425, adjacent each of the cylindrical openings 430–440, is operable to selectively emit illumination (e.g., red, green and blue light). The illumination is utilized to prompt a user to plug one or more peripheral components into one or more cylindrical openings 430–440 of the multiple audio jack assembly 400.

In a first exemplary implementation, the multiple audio jack assembly 400 is to be configured to provide six speaker surround sound output. A first one of the jacks 430, 460–465 may be configured to operably output left and right front audio signals. A first portion of the insulative housing 415, proximate the first jack 430, 460–465, may be configured to emit a first color (e.g., red) of light. A second one of the jacks 435, 470–475 may be configured to operably output left and right rear audio signals. A second portion of the insulative housing 420, proximate the second jack 435, 470–475, may be configured to emit a second color (e.g., green) light. A third one of the jacks 440, 480–485 may be configured to operably output center and subwoofer audio signals. A third portion of the insulative housing 425, proximate the third jack 440, 480–485, may be configured to emit a third color (e.g., blue) of light. The red, green and blue lights provide optical prompts to insert the applicable plug of the appropriate speakers.

In another exemplary implementation, the multiple audio jack assembly 400 is to be configured to provide a stereo speaker output and a microphone input (not shown). To start, a first one of the jacks may be configured to operably output left and right front audio signals. A first portion of the insulative housing proximate the first jack may be configured to emit a flashing light until insertion of the stereo speaker plug into the jack is detected (e.g., impedance sensing). A second one of the jacks may be configured to operably receive a microphone audio signal. Upon detection that the stereo speakers have been plugged in, a second portion of the insulative housing proximate the second jack may be configured to emit a flashing light until insertion of the microphone plug into the second jack is detected. The third jack may not configured to provide an input or output audio signal and the insulative housing proximate the second jack may not be configured to emit light.

Figure 5A:
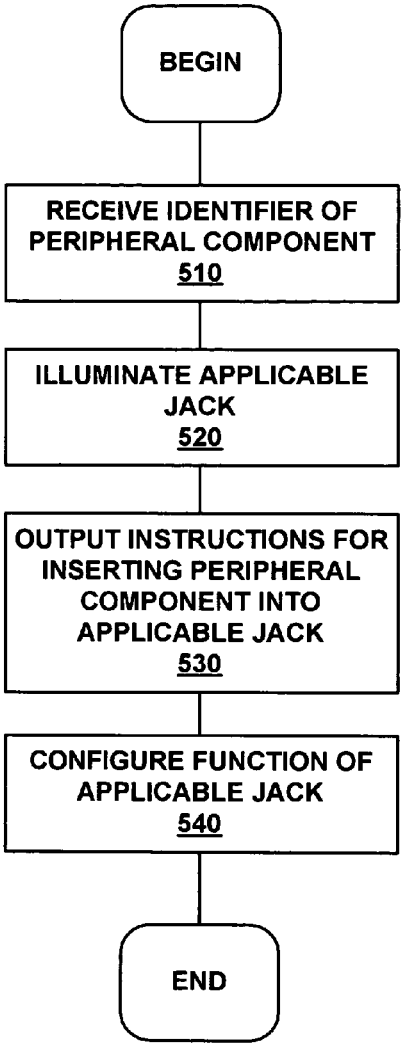
FIG. 5A shows a flow diagram of a computer implemented method for configuring a plurality of audio jacks, in accordance with one embodiment of the present invention.

Referring now to FIG. 5A, a flow diagram of a computer implemented method for configuring a plurality of audio jacks, in accordance with one embodiment of the present invention, is shown. As depicted in FIG. 5A, the method begins with receipt of an identifier of a peripheral component to be added to a device, at 510. In one implementation, a user may specify the peripheral component utilizing a user interface (e.g., graphical and/or audio) provided by the device. Upon receipt of the identification of a peripheral component to be added to the device, an appropriate jack is illuminated, at 520. In one implementation, hardware in the device and/or software running on the device sends an indicator signal to the applicable jack for illuminating the jack (e.g., steady illumination, flashing illumination, flashing followed by steady illumination, etc.). At optional process 530, instructions for inserting the plug of the peripheral component into the applicable jack may be provided. In one implementation, the instructions may be provided by the user interface. At 540, the applicable jack is configured to provide the appropriate audio function (e.g., audio output, audio input, etc.).

Figure 5B:
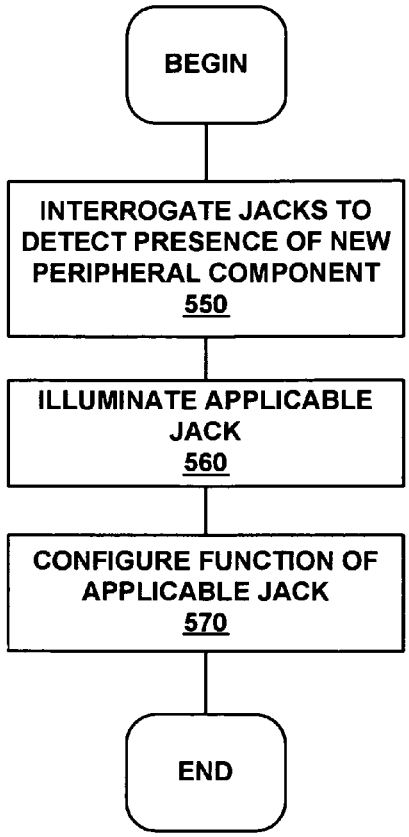
FIG. 5B shows a flow diagram of another computer implemented method for configuring a plurality of audio jacks, in accordance with one embodiment of the present invention.

Referring now to FIG. 5B, a flow diagram of another computer implemented method for configuring a plurality of audio jacks, in accordance with one embodiment of the present invention, is shown. As depicted in FIG. 5B, the method begins with, the device may interrogate one or more jacks to detect the presence of a new peripheral component, at 550. In one implementation, interrogating the jacks may include impedance sensing. At 560, the device causes the jack in which a new peripheral component has been inserted, to be illuminated. In one implementation, the illumination may act as a visual confirmation of detection of the peripheral component. At 570, the applicable jack is configured to provide the appropriate audio function (e.g., audio output, audio input, etc.). In one implementation, a particular color of light is output by the jack to indicate the audio function provided by the configured jack (e.g., red for audio output, blue for audio input, etc.).

It is appreciated that the above described methods for configuring a plurality of audio jacks may be implemented as independent methods of configuring a particular device, as alternative methods of configuring a particular device, or as a combined method of configuring a particular device.

Figure 6:
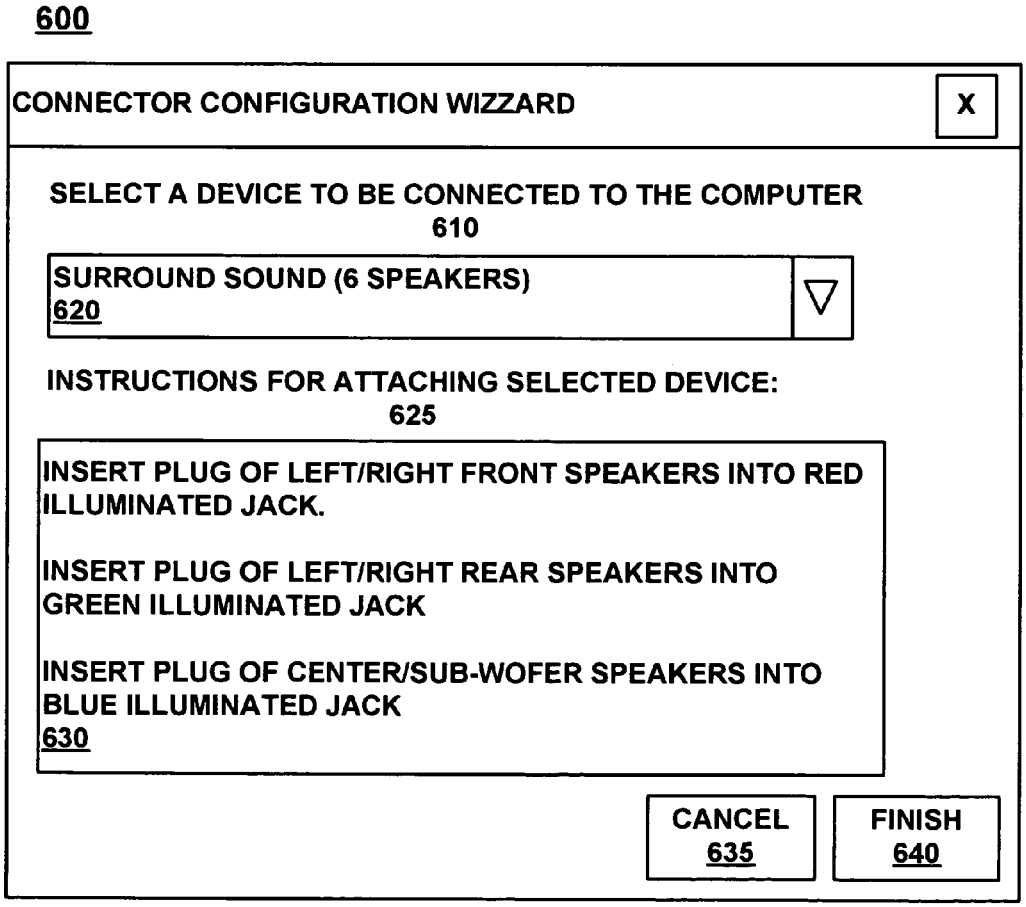
FIG. 6 shows an exemplary on-screen displayed graphical user interface for configuring a plurality of audio jacks, in accordance with one embodiment of the present invention.

Referring now to FIG. 6, an exemplary graphical user interface 600 for configuring a plurality of audio jacks, in accordance with one embodiment of the present invention, is shown. The graphical interface 600 may be provided by a device. As depicted in FIG. 6, the graphical user interface 600 may include text for instructing a user to select a peripheral component to be connected 610. The graphical user interface 600, in one implementation, may provide a drop down menu for selecting a device 620. Upon selection of a particular peripheral component, the graphical user interface may display instructions for plugging the identified peripheral component into one or more jacks that have been configured to connect the specified peripheral component to the device 625–630. The instructions specify the optical indicator provided by one or more jacks and the particular plug to be inserted into each jack. Thereafter, the user may select cancel 635 to abort the changes or finish 640 to accept the configuration changes.

In one implementation, a user indicates that he or she wants to attach surround sound speakers to a device by selecting the corresponding entry from the pull-down menu 610 of the graphical user interface 600. The graphical user interface 600 in response to the indication that the user wants to add surround sound speakers to the device, may then provide instructions for attaching the surround sound speakers 625–630. The instructions may state that: the left and right front speakers are to be plugged into the red illuminated jack; the left and right rear speakers are to be plugged into the green illuminated jack; and the center and sub-wofer speakers are to be plugged into the blue illuminated jack. The user's selection of surround sound speakers from the drop down menu 610 may also cause the device to configure: the red illuminated jack to operably output left and right front audio signals the green illuminated jack to operably output left and right rear audio signals; and the blue illuminated jack to operably output center and subwoofer audio signals. After a period of time or upon detection that the speakers have been plugged into the jacks, the illumination of the jacks may be turned off.

Figure 7:
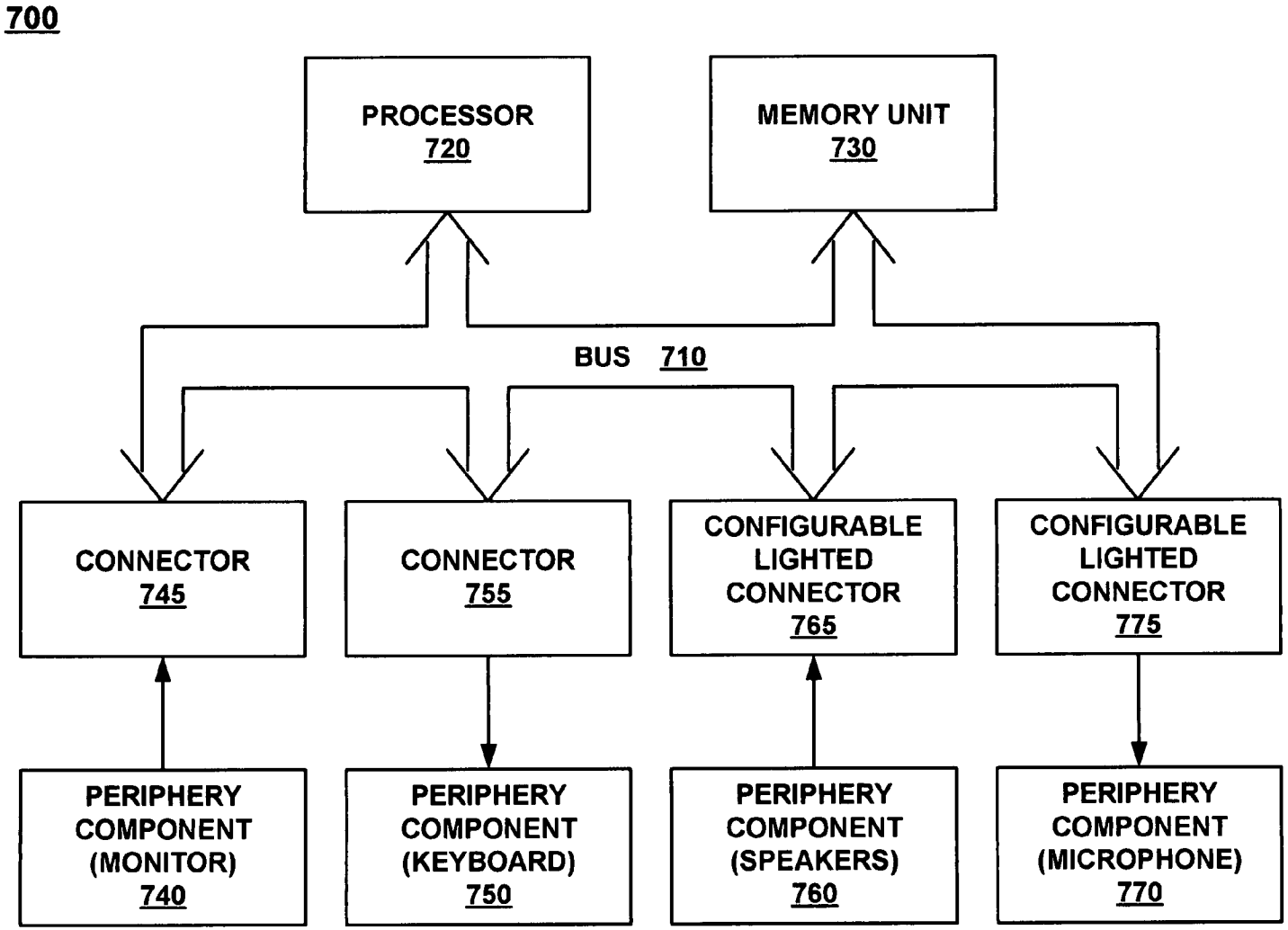
FIG. 7 shows a block diagram of an exemplary computing system for implementing embodiments of the present invention.

Referring now to FIG. 7, a block diagram of an exemplary computing system for implementing embodiments of the present invention is shown. Although illustrated with reference to a computing system, it is appreciated that embodiments of the present invention may be implemented in desktop computers, laptop computers, palm-sized computers, tablet computers, game consoles, personal entertainment centers, media center PCs, cellular telephones, PDAs or other portable wireless appliances, or similar devices. As depicted in FIG. 7, the exemplary computer system includes a bus, a processor, a memory unit and a plurality of peripheral components. The processor 720 and memory unit are coupled to the bus 710. The processor 720 processes information and instructions. The bus 710 sends and received information and instructions for the processor 720. The memory unit 730 stores information and instructions for the processor 720. The memory unit 730 may include volatile memory (e.g. random access memory, static RAM, dynamic RAM, and the like), non-volatile memory (e.g. read only memory, programmable ROM, flash memory, EPROM, EEPROM, and the like), mass data storage (e.g. hard disk, optical disk, floppy disk, and the like), and the like.

The computer system 700 also includes one or more peripheral components 740, 750, 760, 770 (e.g. display, keyboard, pointing device, speaker, microphone, network interface card, and the like) coupled to the bus 710. One or more peripheral components 740, 750 may be coupled to the bus 710 by one or more conventional art connectors 745, 755. The conventional art connectors 745, 755 provide a communication signal transmission function. One or more peripheral components 760, 770 are coupled to the bus 710 by one or more configurable lighted connectors 765, 775. The configurable lighted connectors 765, 775 provide a communication signal transmission function and a configuration indicator function.

Certain processes and steps of the present invention are realized as a series of instructions (e.g. object code) that reside on a computer-readable medium such as the memory unit 730, and are executed by the processor 720. When executed, the instructions cause the processor 720 to provide an operating system and one or more application programs. One of the applications may provide for configuring the one or more configurable lighted connectors 765, 775. In one implementation, the application for configuring the configurable lighted connectors 765, 775 may provide the user with a graphical user interface. In one implementation, a user may specify a peripheral component to be added utilizing the graphical user interface. Upon receipt of the identification of a peripheral component to be added, an appropriate connector is illuminated. In one implementation, hardware and/or the application for configuring the configurable lighted connectors 765, 775 sends an indicator signal to the appropriate connector for illuminating the connector (e.g., steady illumination, flashing illumination, flashing followed by steady illumination, etc.). The graphical user interface may also provide instructions for inserting the mating connector of the peripheral component into the appropriate connector. The application for configuring the configurable lighted connectors 765, 775 also configures the appropriate connector to provide the appropriate audio function (e.g., audio output, audio input, etc.). In one implementation, a particular color of light is output by the appropriate connector to indicate the audio function provided by the configured lighted connector (e.g., red for audio output, blue for audio input, etc.).

Alternatively or in combination with the graphical user interface, the application may interrogate one or more of the configurable lighted connectors 765, 775 to detect the presence of a new peripheral component. In one implementation, interrogating the configurable lighted connectors 765, 775 may include impedance sensing. The application for configuring the configurable lighted connectors 765, 775 causes the connector, in which a new peripheral component has been inserted, to be illuminated. In one implementation, the illumination may act as a visual confirmation of detection of the peripheral component. The application for configuring the configurable lighted connectors 765, 775 also configures the connector to provide the appropriate audio function (e.g., audio output, audio input, etc.). In one implementation, a particular color of light is output by the connector, in which a new peripheral component has been inserted, to indicate the audio function provided by the configured lighted connector (e.g., red for audio output, blue for audio input, etc.).

Embodiments advantageously simplify connectivity of peripheral components to the device for the user. Embodiments may advantageously reduce the cost of the device by reducing the number of jacks in the device. Embodiments may also advantageously reduce the form factor of the device by reducing the number of jacks in the device. Embodiments may also advantageously free-up available device surface area previously occupied by conventional art audio jacks for use by additional circuits in the device.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A communication connector comprising:

a housing comprising a head portion and a body portion;

a light source disposed in said housing, operable to emit illumination from said head portion;

an opening in said housing, for removably receiving a mating communication connector;

a first interconnect operable to couple a communication signal between a device and a peripheral component; and a second interconnect operable to couple an indicator signal to control said light source.

2. The communication connector according to claim 1, wherein illumination emitted by said light source is a function of said indicator signal.

3. The communication connector according to claim 2, wherein said illumination is emitted from said head portion proximate said opening.

4. The communication connector according to claim 2, wherein said indicator signal causes said light source to selectively emit a steady illumination.

5. The communication connector according to claim 2, wherein said indicator signal causes said light source to selectively emit illumination having one of a plurality of colors.

6. The communication connector according to claim 2, wherein said indicator signal causes said light source to selectively emit a flashing illumination.

7. An jack connector comprising:

an insulative housing comprising a body portion and a head portion;

a cylindrical opening extending through said head portion and extending partially into said body portion;

a light source disposed in said insulative housing proximate the head portion, wherein said light source is operable to emit light from said head portion;

a first electrical interconnect comprising;

a terminal portion for fixedly coupling said jack connector to a device; and a contact portion comprising a resilient conductive element disposed in said cylindrical opening for engaging a plug connector; and a second electrical interconnect for coupling an indicator signal to control said light source.

8. The jack connector according to claim 7, wherein said light source comprises a light emitting diode.

9. The jack connector according to claim 7, wherein said light source comprises a multi-color light emitting diode.

10. The jack connector according to claim 7, wherein said light source is operable to emit said light from a portion of said head portion proximate to said cylindrical opening.

11. The jack connector according to claim 10, wherein said head portion of said insulative body comprises a lens for directing said emitted light.

12. The jack connector according to claim 10, wherein said head portion of said insulative body comprises a diffraction grating for dispersing said emitted light.

13. The jack connector according to claim 10, wherein said head portion of said insulative body comprises a filter for selectively transmitting a particular color of said emitted light.

14. The jack connector according to claim 7, wherein said jack connector comprises an audio jack.

* * * * *